US005607328A

United States Patent [19]

Joly

[11] Patent Number: 5,607,328

[45] Date of Patent: Mar. 4, 1997

[54] ONE-PIECE RECEPTACLE TERMINAL

[75] Inventor: Jean C. Joly, Osny, France

[73] Assignee: The Whitaker Corporation, Wilmington, Del.

[21] Appl. No.: 593,218

[22] Filed: Jan. 29, 1996

[30] Foreign Application Priority Data

Feb. 17, 1995 [FR] France ..... 95 01846

[51] Int. Cl.[6] ..... H01R 11/22

[52] U.S. Cl. ..... 439/852; 439/851

[58] Field of Search ..... 439/851, 852, 439/856, 862, 842, 843

[56] References Cited

U.S. PATENT DOCUMENTS

| | | | |
|---|---|---|---|
| 4,834,681 | 5/1989 | Chaillot | 439/856 |
| 5,188,545 | 2/1993 | Hass et al. | 439/851 |
| 5,334,058 | 8/1994 | Hotea | 439/851 |
| 5,360,356 | 11/1994 | May et al. | 439/851 |
| 5,443,592 | 8/1995 | Ittah et al. | 439/851 |
| 5,468,163 | 11/1995 | Egenolf | 439/851 |

*Primary Examiner*—David L. Pirlot
*Assistant Examiner*—Brian J. Biggi
*Attorney, Agent, or Firm*—Driscoll A. Nina

[57] ABSTRACT

A single-piece electrical receptacle terminal comprises a contact section having an inner box-shaped contact body and an outer body wrapped therearound. The outer contact body provides a more robust structure that protects the inner contact body, as well as providing a window for engagement with a connector housing locking lance, and an additional spring beam for increasing the contact arm spring force. The outer body also has a lead-in section for smoothly guiding a male terminal into the contact area as well as enhancing the ease of insertion of the receptacle terminal through a seal cavity. The long outer body that extends over of the whole length of the inner contact also provides a stable support of a cavity of a connector housing. The single-piece design where the layout extends in the longitudinal direction reduces material waste and provides for a more cost-effective design than a two piece terminal.

16 Claims, 4 Drawing Sheets

ONE-PIECE RECEPTACLE TERMINAL

BACKGROUND OF THE INVENTION

1. Field of the Invention

This invention relates to a single-piece stamped and formed electrical receptacle terminal.

2. Description of the Prior Art

In many applications in the electrical industry it is a continuous requirement to provide more cost-effective yet more compact, sturdy and reliable electrical terminals. In certain applications, for example in the automotive industry, it is a further requirement that such terminals are suitable for assembly into sealed connector housings as many automotive connectors require sealing. It is common to find electrical terminals stamped and formed from sheet metal that have a connection section such as a crimp barrel for connection to a conducting wire, further comprising a contact section for connection to a complementary terminal, and means for securing the terminal within the cavity of a connector housing. It is common to find receptacle terminals for mating with tab or pin terminals to have resilient cantilever beam contact arms extending from opposed sides of the terminal to receive the complementary pin or tab therebetween. In certain applications, an additional outer spring body stamped and formed from a stronger material such as stainless steel is positioned around the contact section of the terminal and serves to provide means for securing the terminal within the connector housing and extra spring support for increasing the spring strength of the inner contact arms. Such an outer spring body often has the effect of protecting the inner contact area thus making the receptacle terminal more robust, but also increases the contact pressure and provides a stronger support for securing of the terminal in a connector housing.

It would be advantageous to re-unite the advantages of having an outer body around an inner receptacle contact section, and of a terminal that can be easily inserted through holes of a sealing material without causing damage thereto for reliable assembly in a sealed connector, and of protecting the inner receptacle contact section from damage either by false insertion of a complementary tab terminal, entanglement or other such external influences. Furthermore, the terminal should be cost-effective to manufacture.

There are also certain applications where there is a need for short circuiting adjacent contacts in a connector housing e.g. in automotive airbag detonator connectors where a short circuit between adjacent contacts must be created to prevent detonation of the airbag when connectors are separated. Provision of a separate outer body around an inner contact body may not be reliable due to the possibly poor electrical connection therebetween. Furthermore, it is typical to provide a separate short circuit spring member that interconnects adjacent terminals. The latter is thus an additional part which is costly, and requires additional space in the connector housing. It would be advantageous to provide a more cost-effective and reliable terminal for short circuit applications, and that is also compact.

SUMMARY OF THE INVENTION

It is therefore an object of this invention to provide a cost-effective, sturdy and reliable receptacle terminal.

It is a further object of this invention to provide a cost-effective, sturdy and reliable receptacle terminal suited for assembly in sealed connectors.

It is another object of this invention to provide a receptacle terminal that has a contact section with increased protection against stubbing by a mating tab terminal or other external solicitation, in a cost-effective and compact arrangement.

It is another object of this invention to provide a receptacle terminal for short circuiting an adjacent terminal of a connector for short circuiting applications, that is reliable, cost-effective and compact.

The objects of this invention have been achieved by providing a single-piece stamped and formed electrical terminal having a conductor connection section and a receptacle contact section for mating with a complementary male pin or tab terminal, the contact section comprising an inner body formed from a base from which extend side walls, and opposed resilient contact arms extending therefrom for receiving the complementary terminal therebetween, wherein an outer spring body integrally connected to the inner spring body via a bridging portion is wrapped around the inner contact body. The bridging portion may extend from a complementary terminal receiving end of the inner body base wall to a reversely-bent U-shape that also acts as a complementary terminal guide during initial insertion. Side walls and a top wall of the outer body may be provided with inwardly-folded extensions directed towards the inside of the inner contact body from a pin receiving end of the outer body to act as a complementary terminal insertion guide. The folded-over pin receiving ends of the walls also assist insertion through a seal member without damage to the seal. The outer body may be provided with inwardly directed resilient locking lances that apply pressure against the inner body contact arms for increased spring support thereof. Extension of the outer body over substantially the whole length of the inner contact section provides a long and thus stable support when assembled within a corresponding cavity of a connector housing. A substantially planar rear edge of the outer body can be further used as a support for engagement with secondary locking shoulders of connector housings. Robustness of the terminal can be further enhanced by providing a box-shaped inner contact body with base, side and top walls, and a box-shaped outer body therearound, the inner and outer bodies having seams formed by the folding around of the sheet metal, and that are joined to form the closed box-shapes. An embodiment may comprise a short-circuit contact arm extending from a side wall of the outer body to contact an adjacent terminal.

DETAILED DESCRIPTION OF THE PREFERRED EMBODIMENT

Figure 1:
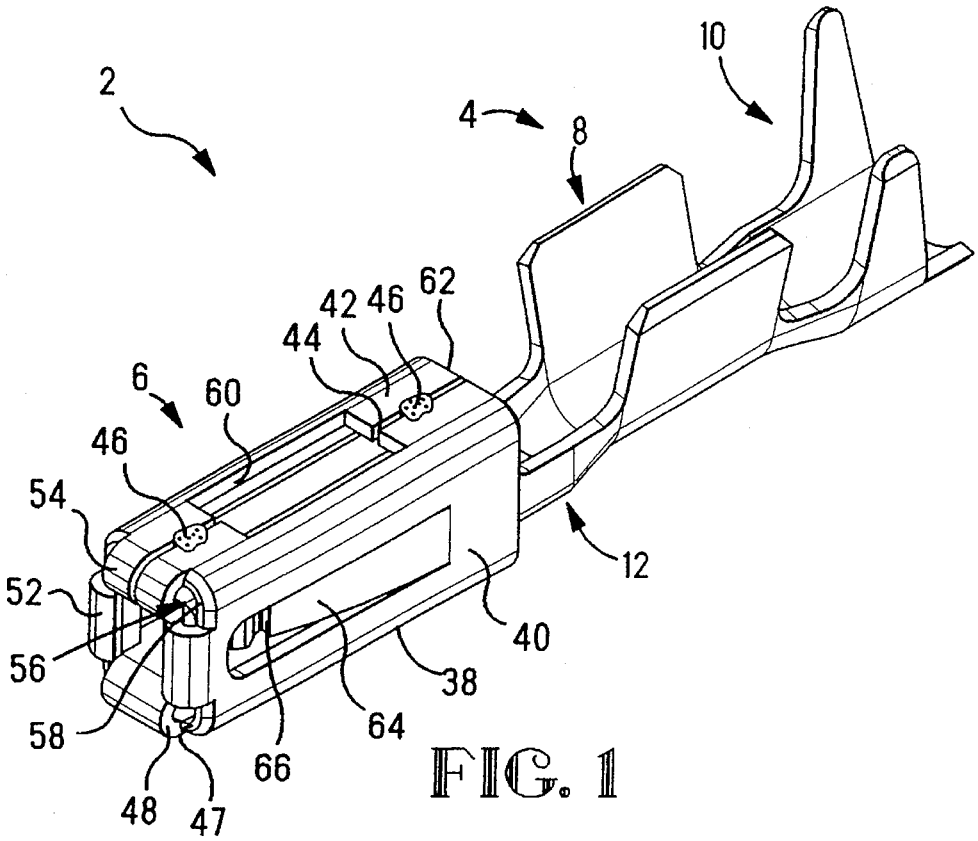
FIG. 1 is an isometric view of a receptacle terminal according to this invention.
Figure 2:
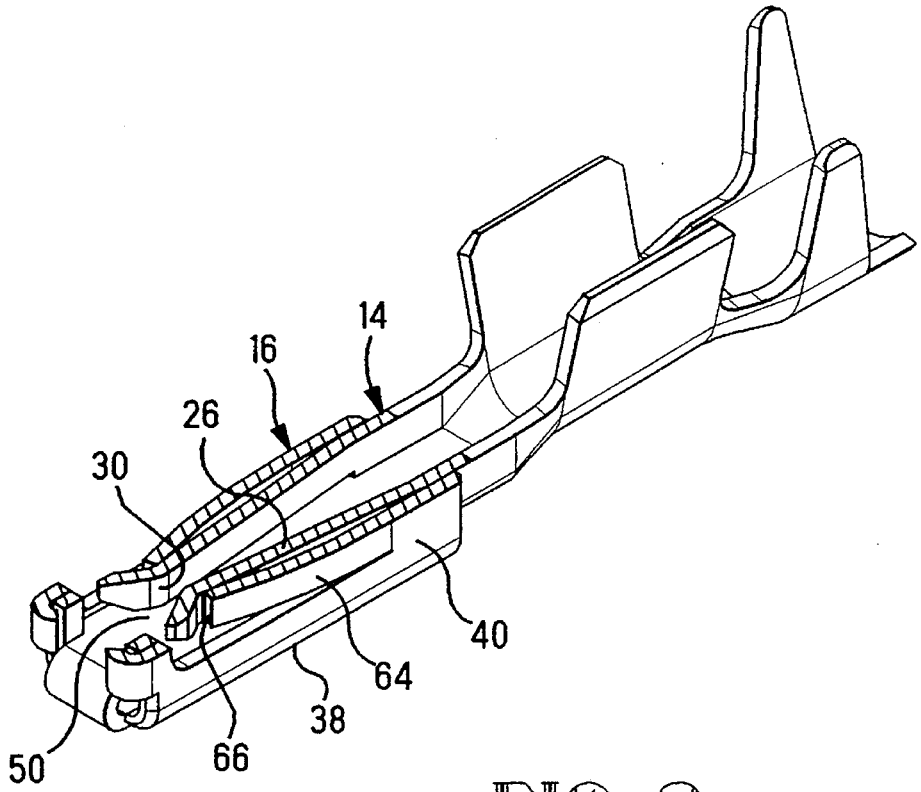
FIG. 2 is a partial cross-sectional isometric view of the terminal of FIG. 1.
Figure 3:
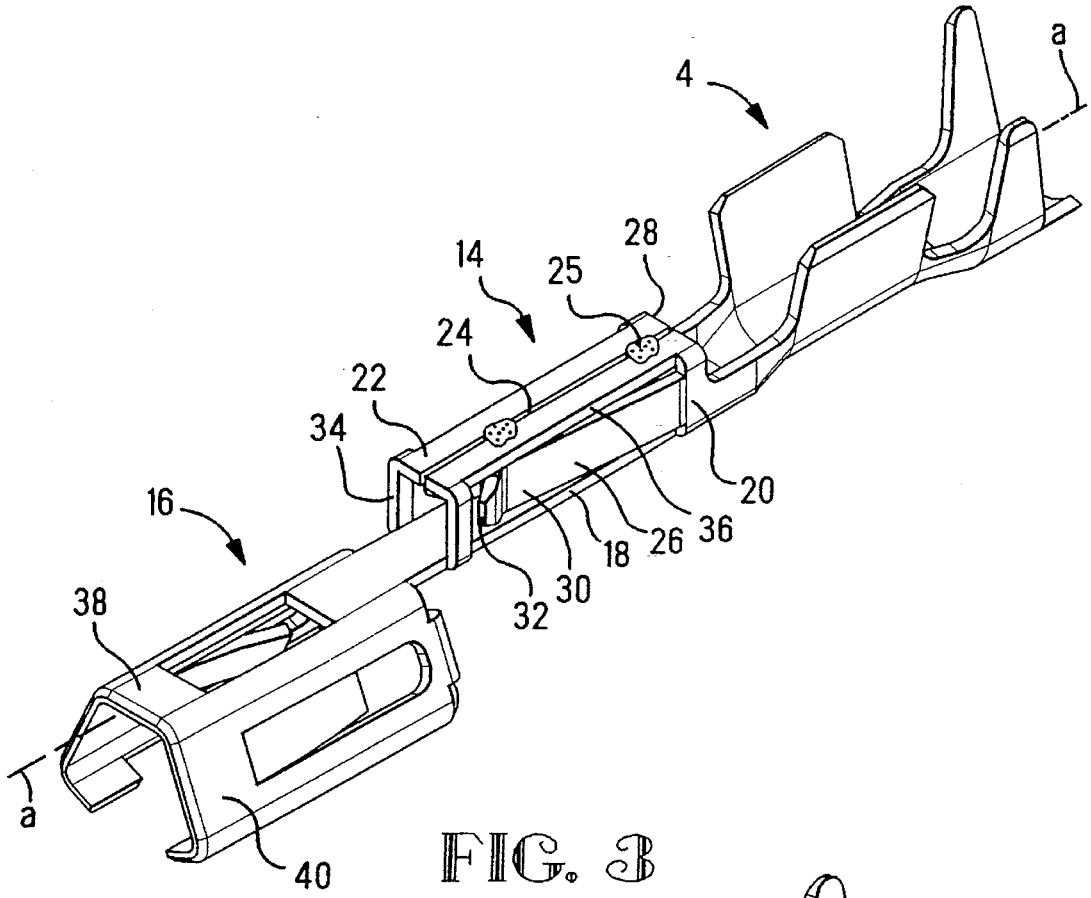
FIG. 3 is an isometric view of the terminal of FIG. 1 partially formed.
Figure 4:
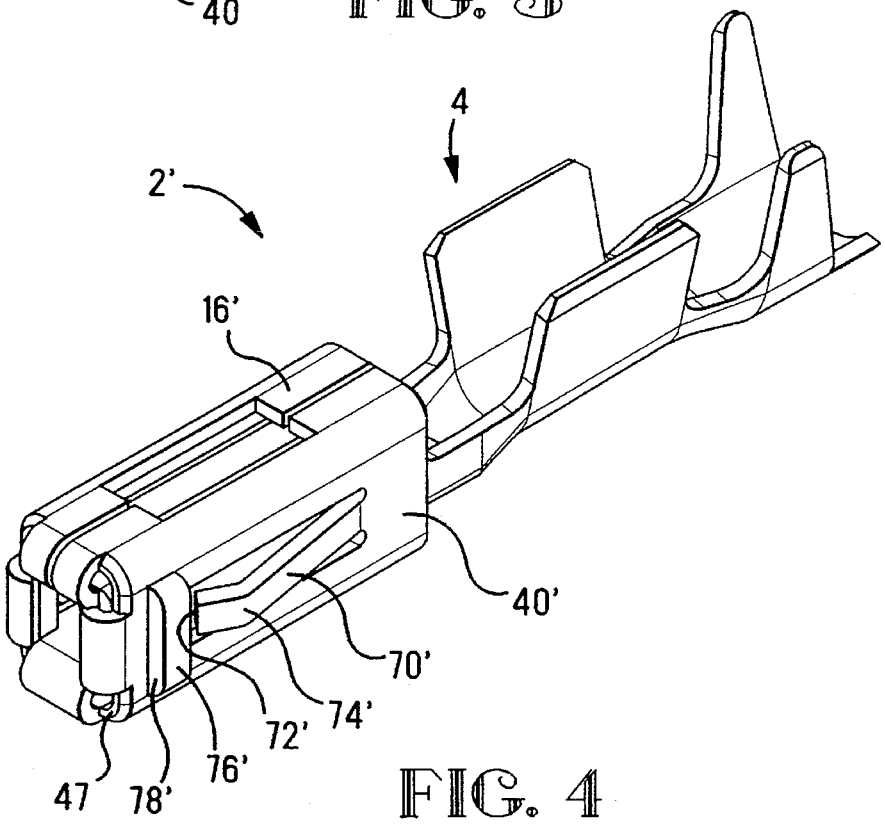
FIG. 4 is an isometric view of another embodiment of a receptacle terminal according to this invention.

Referring to FIGS. 1–3, an electrical receptacle terminal 2 is stamped and formed from sheet metal and comprises a wire connection section 4 and a contact section 6. The wire connection section 4 is for electrical connection to an electrical conductor such as a conducting wire and comprises, in this embodiment, a crimping barrel 8 and strain relief crimping arms 10 for wrapping around the inner strands and outer insulation respectively of a conducting wire. The connection section 4 extends axially via a transition portion 12 to the contact section 6 which comprises an inner contact body 14 and an outer body 16.

The inner contact body 14 comprises a base wall 18, side walls 20 extending from lateral edges of the base wall, and a top wall 22 opposite the base wall and comprising a seam 24 formed by the folding together of the sheet metal to form the box-shaped inner contact body. Cantilever beam contact arms 26 extend from proximate a connection end 28 of the inner contact body convergingly to contact points 30 and then divergingly therefrom to free ends 32 proximate a complementary terminal receiving end 34 of the inner contact body. The contact arms 26 are thus for receiving a complementary tab or pin terminal resiliently therebetween for contact therewith at the contact points 30. The contact arms 26 are stamped out of the side walls 20 which have corresponding windows 36 therefor. The side walls 20 however extend between the base and top walls 18,22 at pin receiving and connection ends for structurally supporting and interconnecting the top and base walls in a robust manner. The seam 24 can be joined together in a secure manner by either welding with weld points 25, or interengagement of lobes on opposed edges of the seam or any known mechanical means common in this industry, although this is not shown. The inner contact body may thus be made relatively robust by virtue of its closed box-shape.

The outer body 16 comprises a base wall, side walls extending therefrom and a top wall that form a box wrapped around the inner contact body 14, the outer body top wall 42 comprising a seam 44 resulting from the folding together of the box-shape from sheet metal strip. The seam 44 can be securely joined together by welding or interengaging lobs or other known clinching means, although this is not shown. The latter would further enhance the robustness of the terminal if required. In FIG. 1, there is a weld spot 46 proximate the connection and terminal receiving ends respectively.

The outer body 16 is integrally attached to the inner body by a bridging portion 48 that extends in a reversely bent manner from the terminal receiving end 34 of the inner contact body base wall 18 into the base wall 38 of the outer body. Due to the rounded reverse fold of the bridging portion 48, it also acts as a smooth inwardly tapered guide for leading a mating pin or tab terminal into a pin receiving area 50 of the inner contact body (FIG. 2). Top and side walls of the outer body also comprise reversely folded portions 52,54 respectively extending from the outer body terminal receiving end 47 to form an inwardly tapered lead-in portion for guiding the tab from all sides into the contact cavity area 50. A complementary tab or pin terminal being inserted into the cavity area 50 is thus prevented from abutment with the pin receiving end 34 of the inner contact body or with free ends 32 of the contact arms 26 to prevent stubbing therewith, and thus damage thereto. The rounded outer surfaces of the lead-in portions 48,52 and 54 also enhance the ease of insertion of the terminal through the cavity of a seal member (e.g. made from an elastomer), and without damage thereto. In certain applications it is common to use elastomeric seals that are positioned at the rear of a connector housing through which the terminals are inserted.

The lead-in portions 48,52 and 54 are separated from each other by corner sections 56 formed by the joining together of adjacent walls, these corner sections 56 being coined to form tapered outer edge surfaces 58 extending from the pin receiving end 47. These coined outer surfaces of the corners 56 provide a smoother outer rounded surface of the pin receiving end 47 for improving insertion through the seal and further reducing the risk of damage thereto.

The outer body 16 comprises a cutout 60 in the top wall 42 which could also be positioned in the base wall 38 or in both the top and base walls, this cutout 60 serving to receive a locking projection of a connector housing therein for securely locking the terminal to the connector housing. Rather than having a cutout 60, it would also be conceivable to provide a projection stamped from the top and bottom walls that engages with a corresponding shoulder in the housing. Generally speaking, portions of the outer body walls can be used for providing retention means in an advantageous manner as cutouts can be made without effecting the structural integrity of the inner contact body whilst the outer contact body nevertheless provides protection and added robustance to the terminal.

A connection end 62 of the outer body 16, proximate the connection section 4, can be positioned surrounding the transition section 12 such that the edges of the outer body connection in 62 are spaced from the transition section in order to allow a locking shoulder (for example a secondary locking member of a connector housing) to be inserted behind the outer body connection end 62 for retention of the terminal within a connector housing cavity. The outer body can thus be made to extend from the terminal receiving end 47 to the connection end 62, these extensions going beyond the inner contact body ends 28,34 to provide a long support surface when mounted within a corresponding housing cavity for stable and accurate positioning (i.e. rocking of the terminal is reduced) within the corresponding housing cavity.

The outer body further comprises spring arms 64 stamped from the outer body side walls 40 adjacent the inner contact arms for applying pressure thereagainst to increase the contact force of the contact arms. The spring arms 64 are cantilever beams that extend from their position proximate the connection end 62 to free ends 66 proximate the contact points 30 of the inner contact arms.

As can be seen in FIG. 3, the outer body 16 extends axially from the inner contact body 14 and connection section 4 when stamped from the metal strip such that efficient use is made of the sheet metal strip from which the terminal is stamped and formed. In other words, the stamped layout of the terminal prior to forming is disposed longitudinally about an axial axis denoted A, the disposition of the outer body 16 axially extending from the inner contact body being more efficient in material use than extending the outer body 16 transversely to the axial axis for example by attachment to one of the edges of the seam 24.

Referring now to FIGS. 4–7, another embodiment of a terminal 2' according to this invention is shown. Many features of the terminal 2' are similar to that of the terminal 2 described hereinabove, and will therefore not be described further-identical features are denoted with the same number as in the embodiments of FIGS. 1–3. New features are denoted with numbers having a prime.

Figure 5:
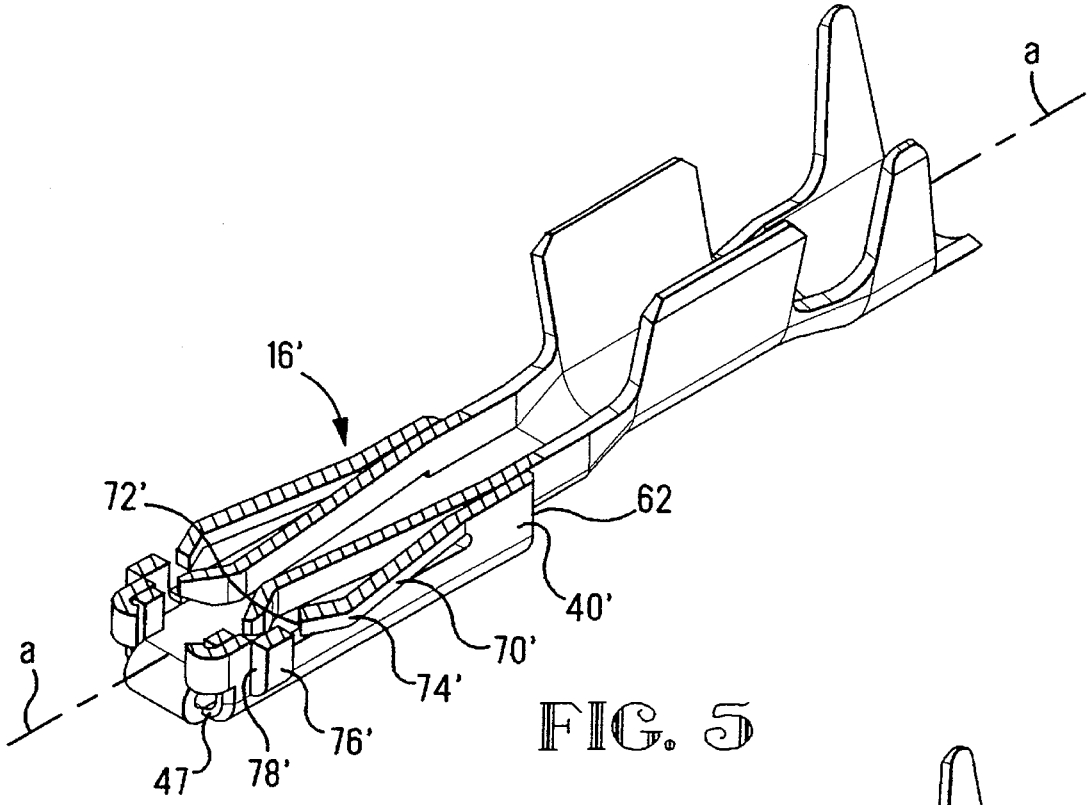
FIG. 5 is a partial cross-sectional isometric view of the embodiment of FIG. 4.
Figure 6:
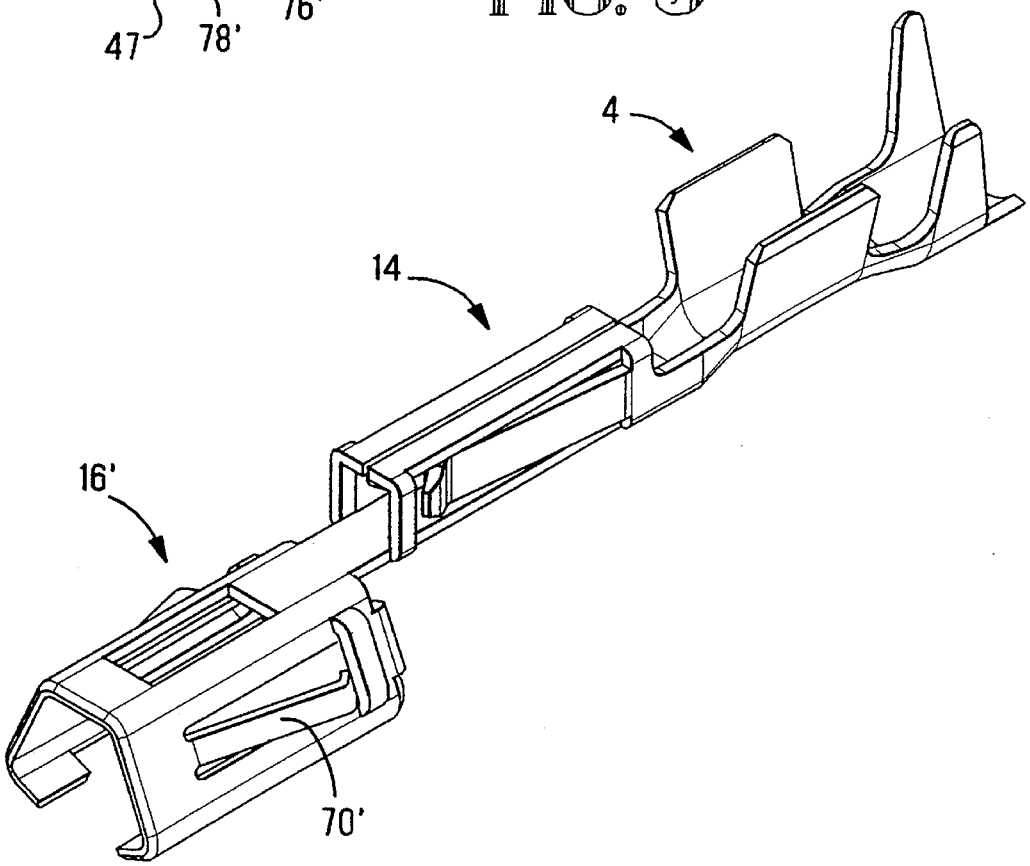
FIG. 6 is an isometric view of the terminal of FIG. 4 partially formed.
Figure 7:
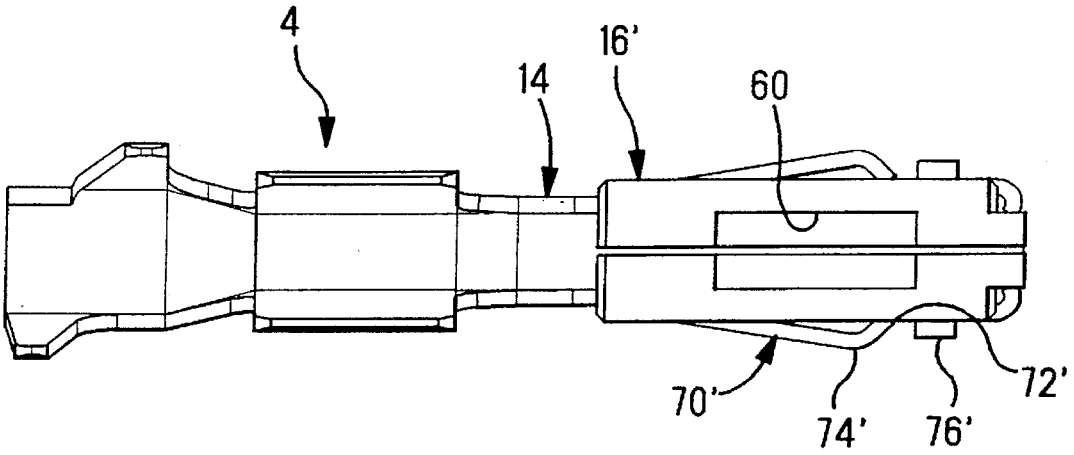
FIG. 7 is a top view of the terminal of FIG. 4.

As can be seen in FIGS. 5 and 6, the connection section 4 and inner contact body 14 of terminal 2' is identical to the connection section and inner contact body of terminal 2. The outer contact body 16' is mounted in a similar way around the inner contact body 14 as that of terminal 2, but has a few differences that will now be described.

Instead of providing additional spring beams 64 as shown in FIG. 2, the terminal 2' comprises outwardly biased short circuit contact arms 70'. The short circuit spring arms 70' are attached proximate the connection end 62 and extend to free ends 72' that are closer to the terminal receiving end 47. A convex contact surface 74' is provided proximate the free ends 72' for resilient abutment against a short circuit arm 70' of an adjacent terminal 2' mounted in a housing of a connector for short circuiting the adjacent terminals. The contact surface 74' may be goldplated to ensure reliable electrical contact between the adjacent terminals. Shoulder members 76' outwardly sheared from side walls 40' of the outer body 16' are positioned beyond the free ends 72' towards the terminal receiving end 47, and purport to prevent damage to the short circuit spring arms 70' by preventing wires or other objects abutting the spring arm free end 72' or catching underneath the spring arm 70'. The shoulder 76' is disposed transversely to the axial direction A and having a front edge 78' that is sheared from the side wall 40' to enable the shoulder 76' to bulge outwardly of the planar side wall 40'.

Provision of the short circuit spring arm 70' integral with the terminal 2' does not affect the mechanical integrity of the inner contact body due to its position on the outer contact body, and furthermore ensures a reliable electrical contact between the short circuit spring arms and the connection section 4 due to it being integral with the inner contact body. The latter also provides a very cost-effective and compact arrangement which eliminates the need for an additional short circuit spring mounted in the connector. Due to the extension of the short circuit contact arm along the whole length of the outer body, great flexibility is achieved which is further enhanced by having the flexibility of both the adjacent terminals. The latter reduces the stress, and therefore increases the reliability of the short circuit function compared to prior art solutions with separate short circuit terminals.

Advantageously therefore, the stamping and forming of a single-piece electrical terminal is more cost-effective than a two piece electrical terminal, yet has a robust structure due to the provision of the outer contact body surrounding the inner contact body which is furthermore provided with a smooth outer profile and a rounded lead-in both for insertion of a complementary terminal into a contact section and for insertion of the terminal through a seal member with ease and without risk of damage thereto. The outer body can advantageously be provided with primary and secondary retention means for securing the inner connector housing cavity, as well as spring arms for application on the inner contact arms to increase the spring force thereof. In other embodiments the outer body could be provided with outwardly biased short circuit spring arms for short circuit contact with adjacent terminals of a connector when unmated. Extension of the outer contact body over the full length of the inner contact body, and possibly beyond, provides a long and stable support of the contact within a corresponding housing cavity. Furthermore a connection end of the outer contact body can extend beyond the connection end of the inner contact body such that it surrounds a transition section interconnecting the connection section to the contact section. The latter allows a connector housing secondary locking shoulder to be positioned therebehind along any of the edges (i.e. base, side or top walls) to act as a secondary locking retention edge in any terminal orientation about the axial axis.

I claim:

1. A single-piece electrical receptacle terminal for mating with a complementary tab or pin terminal, stamped and formed from sheet metal and comprising a connection section and a contact section comprising an inner contact body having contact arms forming an inner cavity area for receiving the mating terminal therein, the inner contact body having a base wall and side walls extending axially from a connection end proximate the connection section to a mating terminal receiving end, characterized in that the terminal comprises an outer body extending integrally from the mating terminal receiving end of the base wall of the inner contact body via a reversely bent bridging portion and surrounding the inner contact body substantially along its whole length from the mating terminal receiving end to the connection end, the outer body comprising a base wall, side walls and a top wall forming a box-shape.

2. The terminal of claim 1 characterized in that the outer body comprises reversely bent-in guide portions extending from a mating terminal receiving end of the outer body in towards the mating terminal receiving cavity area for guiding the mating terminal therein and furthermore providing a smooth outer profile at the receiving end for easy insertion through a seal member.

3. The terminal of claim 2 characterized in that the inner contact body has a box-shape formed by the base wall, side walls and a top wall.

4. The terminal of claim 3 characterized in that the inner contact body has an axial seam extending along the top wall formed by the folding together of the inner contact body, the seam being fastened together for enhanced structural strength.

5. The terminal of claim 1 characterized in that the outer body connection end extends beyond the inner contact connection end, the edge of the outer body connection end spaced from the inner contact body thus forming a shoulder therearound to receive, from any side, a connector housing secondary retention member thereagainst for retention in a connector housing.

6. The terminal of claim 1 characterized in that the outer body comprises primary retention members for cooperation with connector housing primary retention members.

7. The terminal of claim 6 characterized in that the primary retention members are cut-outs in the top or bottom walls.

8. The terminal of claim 1 characterized in that the mating terminal receiving end of the outer body has tapered surfaces at corners formed by the joining of adjacent side and top or bottom walls to provide a smooth outer surface for easier insertion through a cavity of a seal member.

9. The terminal of claim 1 characterized in that there are reversely bent-in guide portions extending from top, bottom and side walls.

10. The terminal of claim 1 characterized in that the outer contact body comprises an axial seam extending along the top wall, the seam being fastened together for enhanced structural strength.

11. The terminal of claim 1 characterized in that the outer body has spring beams that apply pressure on the inner contact arms for added spring strength thereof.

12. The terminal of claim 11 characterized in that spring beams are cantilever beams extending from the side walls proximate the connection end to free ends proximate contact points of the inner contact arms.

13. The terminal of claim 1 characterized in that the outer body has an outwardly biased short circuit contact arm for contacting an adjacent terminal of a connector housing in the unmated condition.

14. The terminal of claim 13 characterized in that there are a pair of the short circuit contact arms, each extending from the side walls of the outer body.

15. The terminal of claim 13 characterized in that the contact arms are resilient cantilever beams extending from a position proximate the connection end to which they are attached, to free ends proximate the terminal receiving end.

16. The terminal of claim 13 characterized in that a shoulder outwardly formed from the side wall is provided proximate the short circuit contact arm free ends towards the terminal receiving end for protection of the short circuit spring arms.

* * * * *